United States Patent [19]

McCurdy

[11] Patent Number: 4,676,188

[45] Date of Patent: Jun. 30, 1987

[54] WALLPAPER WETTING TROUGH

[76] Inventor: William McCurdy, 311 Bowes rd., Concord, Ontario, Canada, L4K 1J1

[21] Appl. No.: 872,260

[22] Filed: Jun. 9, 1986

[51] Int. Cl.[4] ..... B05C 3/12

[52] U.S. Cl. ..... 118/419; 4/538; 118/428; 118/429; 118/DIG. 17; 135/77; 428/904.4

[58] Field of Search ..... 4/538; 118/DIG. 17, 118/419, 428, 429; 428/904.4, 35; 135/77

[56] References Cited

U.S. PATENT DOCUMENTS

| | | | |
|---|---|---|---|
| 2,994,152 | 8/1961 | Donahue | 135/77 X |
| 3,199,819 | 8/1965 | Widmark | 135/77 X |
| 4,244,320 | 1/1981 | McCurdy | 118/419 |
| 4,300,471 | 11/1981 | Desjardins | 118/419 |
| 4,377,983 | 3/1983 | Skarsten | 118/DIG. 17 |

FOREIGN PATENT DOCUMENTS 1046997 1/1979 Canada .

*Primary Examiner*—Henry F. Epstein
*Attorney, Agent, or Firm*—K. Maxwell Hill

[57] ABSTRACT

An upwardly open wallpaper wetting trough made from flexible polystyrene has a metal rod force fitted between the opposite ends of the trough and has vinyl tips fitted over the rod ends to protect the ends of the trough from puncture. An inwardly opening, outwardly extending channel is formed in each end of the trough to receive the ends of the rod in a force fit to maintain the rod in position while a sheet of wallpaper is being pulled through water in the trough guided by the rod.

2 Claims, 1 Drawing Figure

WALLPAPER WETTING TROUGH

FIELD OF INVENTION

The present invention relates to an improved means of assembling the component parts of a wallpaper wetting trough to prevent injury to the gripping means in the end walls of the trough. In particular the invention herein provides the horizontal rod of the assembly with elastomeric tips to protect the trough walls from puncture when the rod is flexed into engagement with the channels formed in the thin plastic end walls of the trough.

PRIOR ART

In my Canadian Pat. No. 1046997 I disclose the means of providing a relatively inexpensive wetting tray or trough made from vacuum-formed plastic having a moulded-in gripping channel formed in its end walls for receiving in pressure engagement the ends of a horizontal bar or tube whose function was to hold the pre-pasted wallpaper under the water while being drawn under the rod through the water in the tray.

DISADVANTAGES OF THE PRIOR ART

While it has been found that the invention as disclosed in the above patent disclosure performs most adequately for some continued use there is the disadvantage that after much rough usage the rod will puncture the thin plastic walls of the channel gripping areas in the end walls of the trough.

OBJECTS OF THE INVENTION

It is therefore, the principal object of the invention to provide a wetting tray for wallpaper that has a horizontal paper guide which interfits into holding channels preformed into the end walls of the tray without injury to the channels after many and rough usages. The object is achieved by encasing the tips of the rod or guide with soft pliable material such as rubber or vinyl and by necking the channel inwardly to provide a dimple or lower bulge in the channel to grip the rod without pressure and thereby protect the wall from being punctured by the rod which is force fitted into the upper neck portion of the channel.

SUMMARY OF THE INVENTION

The invention herein disclosed provides an improved wallpaper wetting trough comprising; an upwardly open elongated elastomeric trough having opposite ends thereon and wherein a rod or tube is horizontally set in position between the ends of the trough with a force fit action into outwardly formed channels in the ends. An elastomeric end member or tip is in surrounding mode about each of the two ends of the rod to protect the channel from puncture as the rod is flexed into force fit position between the end walls. The channel formed in each of the ends of the trough is narrow at its upward facing end to receive the rubber tipped rod in a force fit and is necked inwardly midway to retain the rod in the bulbed bottom part when the rod is manually forced downward to the position of use at the bottom of the channel. The assembled trough and rod can be used together without fear of becoming unassembled even with rough used as the rod on flexing for insertion between the bulbed parts of the channels in the ends is held from falling out by the soft grip of the tips in between the narrowed necks and the bottom of the channels.

IN THE DRAWINGS

With the foregoing object in view and such other objects that become apparent from consideration of this disclosure, the present invention consists of the inventive concept which is comprised, embodied and included in the construction method and combination of parts herein exemplified reference being had to the accompanying drawing in which like reference numerals refer to like parts.

The drawing shows a known type of wetting tray partially cut away at one end to indicate the positioning of a rod in the bulbed part of the channel pre-formed in the end wall of the tray. The rod and its elastomeric tip is shown exploded from its position in the tray.

DESCRIPTION OF THE PREFERRED EMBODIMENT OF THE INVENTION

Figure 1:
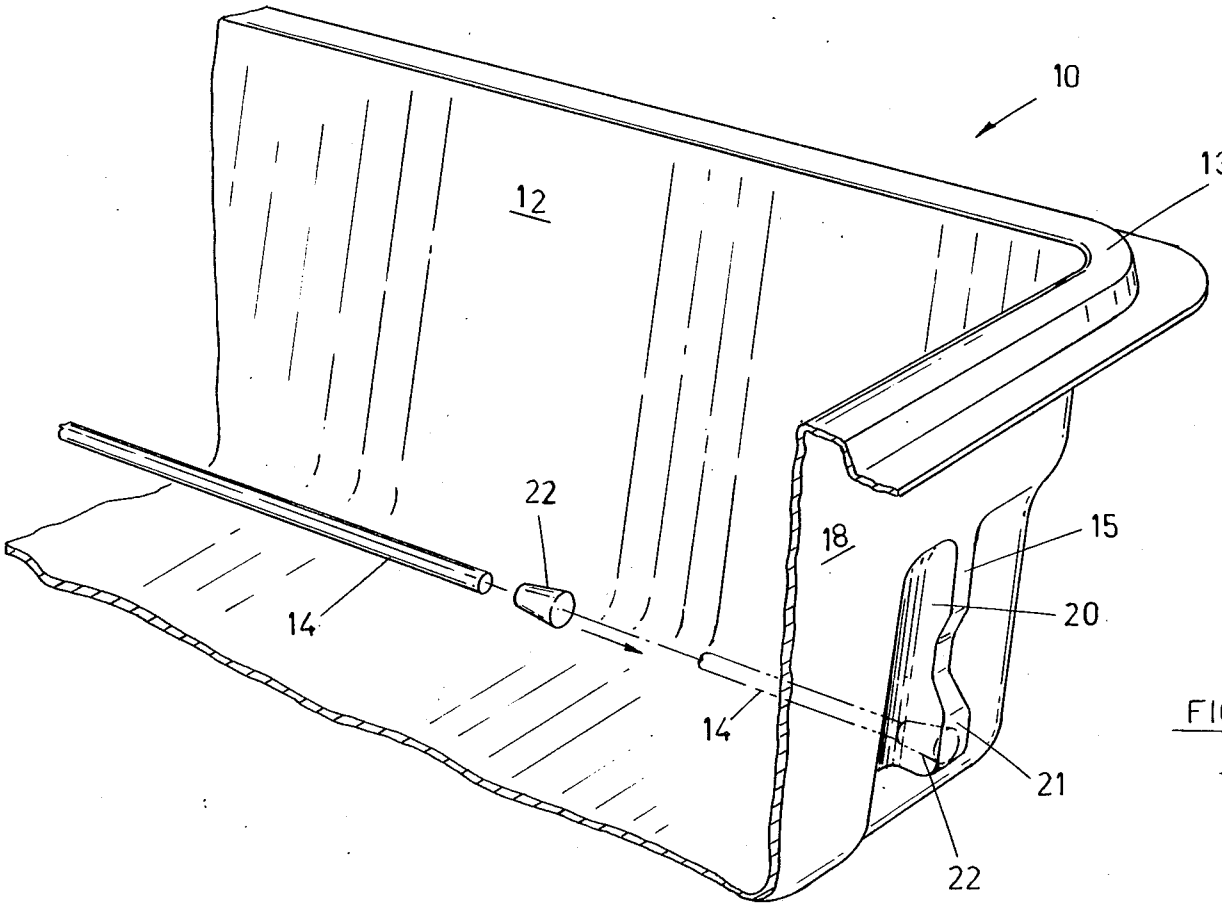

The drawing shows a wallpaper wetting tray of the known kind preformed from flexible plastic and enumerated 10. The tray is cut away in the drawing to show one corner with 13 designating the rim and 12 the side wall. A preformed outwardly extending channel 15 is formed substantially midway of the end 18 of the trough 10. The channel 15 is necked inwardly toward the trough as shown by numeral 20. The neck 20 beginning at the upper side of channel 15 proceeds downwardly and enlarges outwardly to form a bulge, bulb or dimple, as you will, in the bottom of the channel 15. A rod 14 having a rubber or vinyl tip is shown in ghosted lines fitting into the bulb 21. The rod 14 and the protective tip 22 is shown exploded from the operable ghosted position. The rod with a tip 22 attached at both ends is of a combined length of fit suggly at each end in an identical channel in the end of the trough 10 while held into the bulbs 21 by the inwardly exdending neck 20 of the channels. The trough is formed of flexible polystyrene such that when the rod is inserted into the channels it will be constrained by the necked portion 20 at each rod. The rod is flexible to a minor degree allowing it to be force-fitted into the channels and past the constraint of the necks in the channels.

OPERATION AND ASSEMBLY OF THE INVENTION

The trough 10 is formed from flexible polystyrene in multiplies for economy and has a lip 13 for ease of stacking or nesting when sold in multiple lots. A thin metal rod has hollow rubber, nylon or vinyl members 22 pushed over the tips of the rod 14 to hold snuggly thereon in complete surrounding mode. The rod 14 with tips 22 attached is grasped midways and while parallel to the tray bottom, pushed into engagement with the channels. The tips 22 fit into channels 15 but as they are forced downward the constraint of the neck parts of the channel resist the entrance of the rod and the tips, but with slight pressure on the midway part of the rod, it flexes and the neck bulges to allow the tips to seat snuggly into the dimples 21 at the bottom of each channel. The rod is now fitted to the trough and they can be lifted together and wallpaper can be pulled up and guided by the rod in the tray without the rod becoming disloged in the channels of the trough or tray 10. Even after much rough usage the rod does not dislodge or pierce the thin wall of the end 18 because the vinyl tips both protect and restrain the walls from the rod.

The embodiments of the invention in which an exclusive property or privilege is claimed are defined as follows:

1. An improved wallpaper wetting trough comprising;

an upwardly open elongated flexible trough having opposite facing ends thereto; a rod having opposite ends thereon and extending horizontally within said trough between said opposite ends of said trough;

an elastomeric end member surrounding and interfitting over each of said opposite ends of said rod;

and an inwardly opening, outwardly extending channel formed integrally with each of said opposite ends of said trough, said channel having a necked portion formed midway of its length to provide a restriction to the force fitting of the rod and its end member into said channel, a lower end of said channel being bulbed below said necked portion to maintain the rod snuggly gripped in said channel without puncture pressure being created against the ends of the trough, said rod with both ends tipped with said elastomeric ends greater in length than the distance between the ends of the trough measured between the trough ends at the neck portions of the channel to provide a force fit of the rod in the trough.

2. A wallpaper wetting trough as claimed in claim 1 wherein said trough is formed from flexible polystyrene and said end members of said rod are made from flexible polyvinylchloride.

* * * * *